US006830515B2

(12) United States Patent
Rowe

(10) Patent No.: US 6,830,515 B2
(45) Date of Patent: Dec. 14, 2004

(54) METHOD AND APPARATUS FOR SUPPORTING WIDE AREA GAMING NETWORK

(75) Inventor: Rick Rowe, Henderson, NV (US)

(73) Assignee: IGT, Reno, NV (US)

( * ) Notice: Subject to any disclaimer, the term of this patent is extended or adjusted under 35 U.S.C. 154(b) by 8 days.

(21) Appl. No.: 10/241,404

(22) Filed: Sep. 10, 2002

(65) Prior Publication Data

US 2004/0048669 A1 Mar. 11, 2004

(51) Int. Cl.[7] ..... A63F 9/24
(52) U.S. Cl. ..... 463/42
(58) Field of Search ..... 463/40, 41, 42

(56) References Cited

U.S. PATENT DOCUMENTS 4,072,930 A * 2/1978 Lucero et al. ..... 463/47
4,283,709 A * 8/1981 Lucero et al. ..... 463/25
4,357,605 A * 11/1982 Clements ..... 340/825.2
4,582,324 A 4/1986 Koza et al.
4,636,951 A * 1/1987 Harlick ..... 463/25
5,429,361 A * 7/1995 Raven et al. ..... 463/25
5,470,079 A * 11/1995 LeStrange et al. ..... 463/25
5,531,309 A * 7/1996 Kloss et al. ..... 194/202
5,630,755 A * 5/1997 Walsh et al. ..... 700/91
5,655,961 A 8/1997 Acres et al.
5,678,002 A 10/1997 Fawcett et al.
5,970,143 A 10/1999 Schneier et al.
5,970,149 A 10/1999 Johnson
6,035,327 A * 3/2000 Buckley et al. ..... 709/206
6,110,041 A 8/2000 Walker et al.
6,117,011 A * 9/2000 Lvov ..... 463/25
6,301,609 B1 10/2001 Aravamudan et al.
6,383,076 B1 * 5/2002 Tiedeken ..... 463/40
6,622,185 B1 * 9/2003 Johnson et al. ..... 710/48
2002/0077178 A1 6/2002 Oberberger et al.
2002/0094869 A1 7/2002 Harkham
2002/0116615 A1 8/2002 Nguyen et al.
2002/0152120 A1 * 10/2002 Howington ..... 705/14

FOREIGN PATENT DOCUMENTS

CA 2272499 * 11/1999

OTHER PUBLICATIONS

Big Brother Systems and Network Monitor literature, 1997–2000.*

Ben–Dayan, Maor; Ben–Shimon, Sonny; Efron, Niv; Kuperman, Idan; Meller, Tal; SMTP—Simple Mail Transfer Protocol; http://raddist.rad.com/networks/1998/smtp/smtp.htm; 1998; pp. 1–14.

* cited by examiner

*Primary Examiner*—Michael O'Neill
(74) *Attorney, Agent, or Firm*—Beyer Weaver & Thomas, LLP

(57) ABSTRACT

A method of monitoring and providing support to a gaming device that includes monitoring the gaming device to determine an occurrence of an event, generating a message regarding the event, encoding the message, transmitting the message to a remote location over a communication link, receiving the message at the remote location, decoding the message, analyzing the message, and initiating a response to the message. In one embodiment, the event comprises an error or fault and the message regarding the event is transmitted using the simple mail transfer protocol (SMTP). Embodiments of the invention comprise apparatus forming a part of a gaming network or system including gaming devices such as gaming machines. In one embodiment, the apparatus comprises servers associated with a remote service center and message data storage.

17 Claims, 3 Drawing Sheets

METHOD AND APPARATUS FOR SUPPORTING WIDE AREA GAMING NETWORK

FIELD OF THE INVENTION

The present invention relates to a method of providing technical and other support to gaming machines of a wide area gaming network.

BACKGROUND OF THE INVENTION

In the past, gaming machines were generally uniquely associated with a particular casino. Each particular casino maintained its gaming machines. Maintenance of these machines was effected by the relatively direct effort of a technician traveling to a particular machine and servicing it. Gaming technicians employed by the casino would travel about the casino fixing the machines, or the manufacturer of the machine would send a technician to the casino.

Now, casino operators may operate gaming machines at more than one casino. Often these casinos are located far from one another. In fact, gaming continues to expand. This expansion includes a geographic expansion of gaming into other states and regions where gaming did not previously exist.

In addition, in many instances gaming machines are linked across properties belonging to multiple owners. For example, International Game Technology has a system of linked gaming machines located in a wide number of casinos which present its MEGABUCKS® progressive slot game.

As a result of the wide geographic areas over which gaming machines may now be located, service of those machines is more difficult. Technicians may be provided at each and every location. This is costly in terms of manpower.

Often, the technicians are centrally located. This requires the technician to be dispatched to provide service. In the case of a remotely located gaming machine, this may require substantial travel on the part of the technician, at the cost of the technician's man-hours plus travel expenses.

As one attempted solution, a central support center may be created. This support center may receive calls and attempt to provide support via telephone or dispatch technicians. There are a number of problems with these systems. Among the problems are that the game operator is generally required to notify the central support center of any problems. The gaming machine operator, such as casino owner, may not notice a problem for a lengthy period of time, during which the gaming machine was likely out of service and not generating revenue. Further, the system requires that an appropriate person then contact the center, which requires diligent employees.

Providing support also requires that the appropriate personnel identify with some particularity the problem with the gaming machine so that technicians may understand the problem and provide solutions. Mis-identification of the problem will generally result in the technician not providing a working solution. Further, the casino operator is required to implement the solution proposed by the technician over the phone. In many cases, the casino operator is not capable of attempting the solution, such as for the reason it is too complex. This again then requires that a technician actually be dispatched to the site.

An improved method of providing technical support to gaming machines and other devices associated with a gaming network is desired.

SUMMARY OF THE INVENTION

A system and method for monitoring gaming devices and providing support to those gaming devices is provided.

One embodiment of the invention comprises a method and system for monitoring and providing support to a plurality of gaming devices associated with a network. The gaming devices are configured to include an application for establishing a direct communication link between the device and a remote device, such as using the simple mail transfer protocol (SMTP). In one embodiment, the system includes a remote device, such as one or more remotely located servers. These servers are also configured to include an application for establishing the direct communication link.

The gaming devices are also configured to determine when an event meeting predefined criteria occurs. In response to the occurrence of such an event, an event message is generated and transmitted from the gaming device to the remote location.

In one embodiment, the gaming devices include controllers which run operating systems. The operating systems include logs at which event information is stored. The gaming device is configured to monitor this event log to determine when events meeting the predetermined criteria are met.

In one embodiment, the servers are located at a remote service center. A memory or other data storage device is provided for storing messages transmitted from the gaming devices. Preferably, the system also includes means for classifying the event messages and generating a response to the messages. Generated responses may comprise program code for use by the gaming device, or the printing of a service ticket for use by a service technician.

One embodiment of the invention comprises a method for supporting a gaming device from a remote location. In accordance with the method, the gaming device is monitored to determine an occurrence of an event. In response to a detected event, a message regarding the event is generated. In one embodiment, the message is encoded. The message is then transmitted to a remote location, such as a remote service center server. Preferably, the message is transmitted over a dedicated communication link. In one embodiment, the message is transmitted utilizing SMTP. The message is received at the remote location, and if encoded, is decoded. The message is then analyzed and a response is initiated.

In one embodiment of the invention, the system and method are utilized to detect the occurrence of an event or fault at the gaming device and transmit information regarding the event or fault to the remote location. In this manner, the error or fault may be diagnosed and a repair initiated. This repair may be replacement code or a physical repair by a technician.

The detected events may comprise other than errors or faults, such as trends in operating parameters or the like. In this regard, the system and method of the invention are useful in monitoring a gaming device. For example, certain information while not comprising a direct fault preventing the operation of a gaming machine may indicate that the gaming machine is operating incorrectly. This information may comprise, for example, higher than normal payouts.

The system and method of the invention are applicable to gaming devices comprising gaming machines which are electronically controlled and configured to present a game to a player, as well as other gaming devices such as accounting stations and the like. The system and method are applicable to gaming devices which are associated with a local area network, such as a local casino network. This local area network may be part of a wide area network including a plurality of local area networks. For example, the wide area network may comprise a network linking a number of individual casino networks. In accordance with the invention, messages may be transmitted from the gaming devices via the local and wide area networks to the remote location.

In accordance with the invention, a single system is provided for monitoring and providing support to a number of gaming devices which are located in a wide variety of remote locations. Event messages are transmitted on an immediate basis using a dedicated communication link, assuring their receipt and attention.

Further objects, features, and advantages of the present invention over the prior art will become apparent from the detailed description of the drawings which follows, when considered with the attached figures.

DETAILED DESCRIPTION OF THE INVENTION

The invention is a method and system for providing support to gaming machines or other devices of a gaming network. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a method and system by which problems may be identified in a gaming network, including at any of a plurality of gaming machines and other devices, and by which support may be provided for remedying identified problems. The invention also comprises a method and system for tracking and storing information regarding various system and gaming machine operating parameters, including errors and failures.

Figure 1:
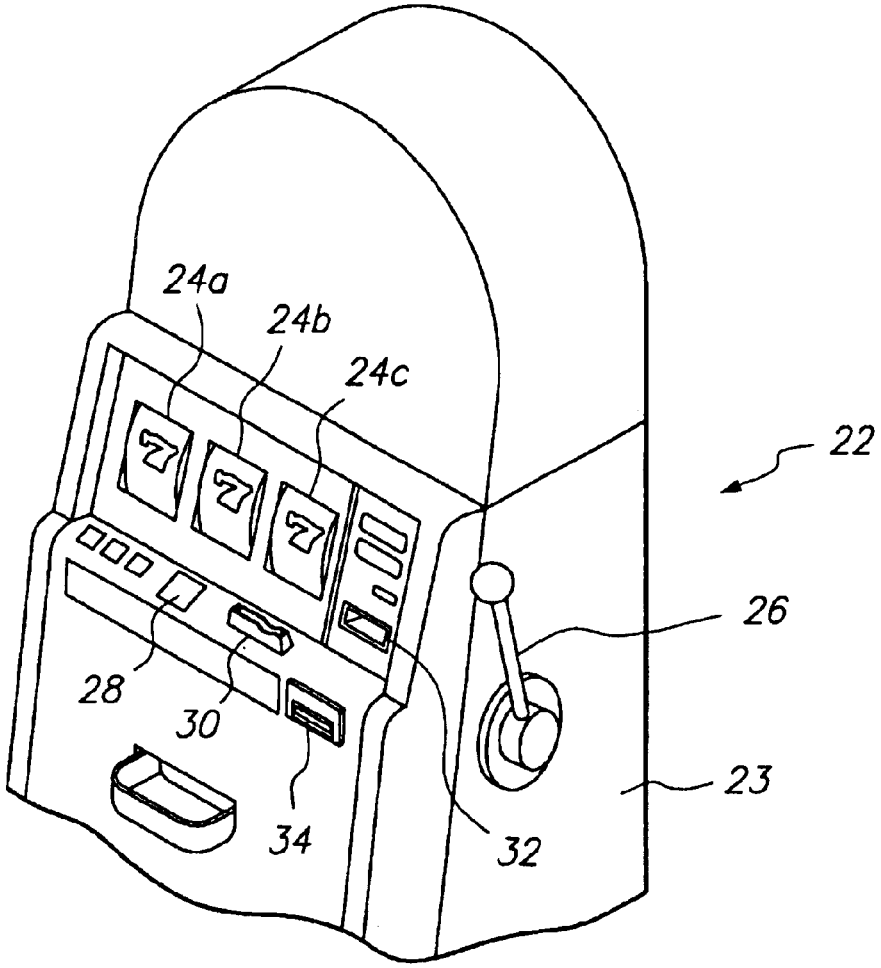
FIG. 1 is a perspective view of a gaming machine of the type which may be used in a system and method of the invention.

One or more embodiments of the invention comprise a configuration of a gaming system. In one embodiment, the gaming system includes a plurality of gaming machines 22. The gaming machines 22 may be of a variety of types. FIG. 1 illustrates one embodiment of such a gaming machine 22. In general, the gaming machine 22 is adapted to present at least one game for play to a player. As illustrated, the gaming machine 22 includes a housing 23 which supports and/or houses the various components of the gaming machine 22. In the embodiment illustrated, the gaming machine 22 is adapted to present a game of "slots," and includes three rotating reels 24*a,b,c*. A handle 26 or spin button 28 may be used to effectuate rotation of the reels 24*a,b,c*.

In this well known game, a player may be declared a winner of the game and awarded an award if the result of the rotation of the reels 24*a,b,c* is a predetermined combination of symbols. It should be understood that the gaming machine 22 may be adapted to present one or more of a wide variety of games. Depending upon the game presented, the configuration of the machine may vary. For example, in the event the gaming machine 22 is adapted to present the game of video poker, then the gaming machine 22 may include a video display.

In one or more embodiments of the invention, the gaming machine 22 is adapted to present a wager-type game. In this arrangement, a player is required to place a bet or wager in order to participate in the game. In the event the outcome of the game is a winning outcome, then the player may be provided with an award such as coins or currency, or credits which may be redeemed for prizes or money. In one arrangement, the award may be winnings in proportion to the amount wagered or bet by the player.

In order to accept a wager, the gaming machine 22 may include a coin acceptor 30 for accepting coins. The gaming machine 22 may also include a bill acceptor or validator 32 for accepting paper currency. The gaming machine 22 may be provided with other means for accepting or verifying value, such as a credit card reader.

In one embodiment, the gaming machine 22 may be arranged to generate tickets or receipts using a receipt printer 34. In one embodiment, these tickets or receipts may represent value, in similar manner to currency. The tickets or receipts may be provided to the gaming machine 22 for value, such as to the bill/receipt validator 32. The details of such a system are well known to those of skill in the art and not described herein. One example of such a system is known as the EZ-PAY™ system developed by International Game Technology.

In a preferred embodiment, one or more aspects of each gaming machine 22 are computer controlled. In one embodiment, the gaming machine 22 includes a gaming machine controller (not shown). The gaming machine controller may comprise a processor and memory, the processor capable of executing code which is stored in the memory. This code may be used by the gaming machine controller to control various aspects of the gaming machine 22, including peripheral devices such as the bill validator 32, coin acceptor 30, and the reels or display. Thus, as one aspect of the "control" function, the gaming machine controller may be configured to execute code which causes a game to be presented to a player of the gaming machine 22. In one or more embodiments, the gaming machine controller may include an operating system comprising hardware and/or software. The operating system may be of a variety of types, including those currently well known or those developed in the future, such as Windows®, Windows NT®, and Linux®.

Figure 2:
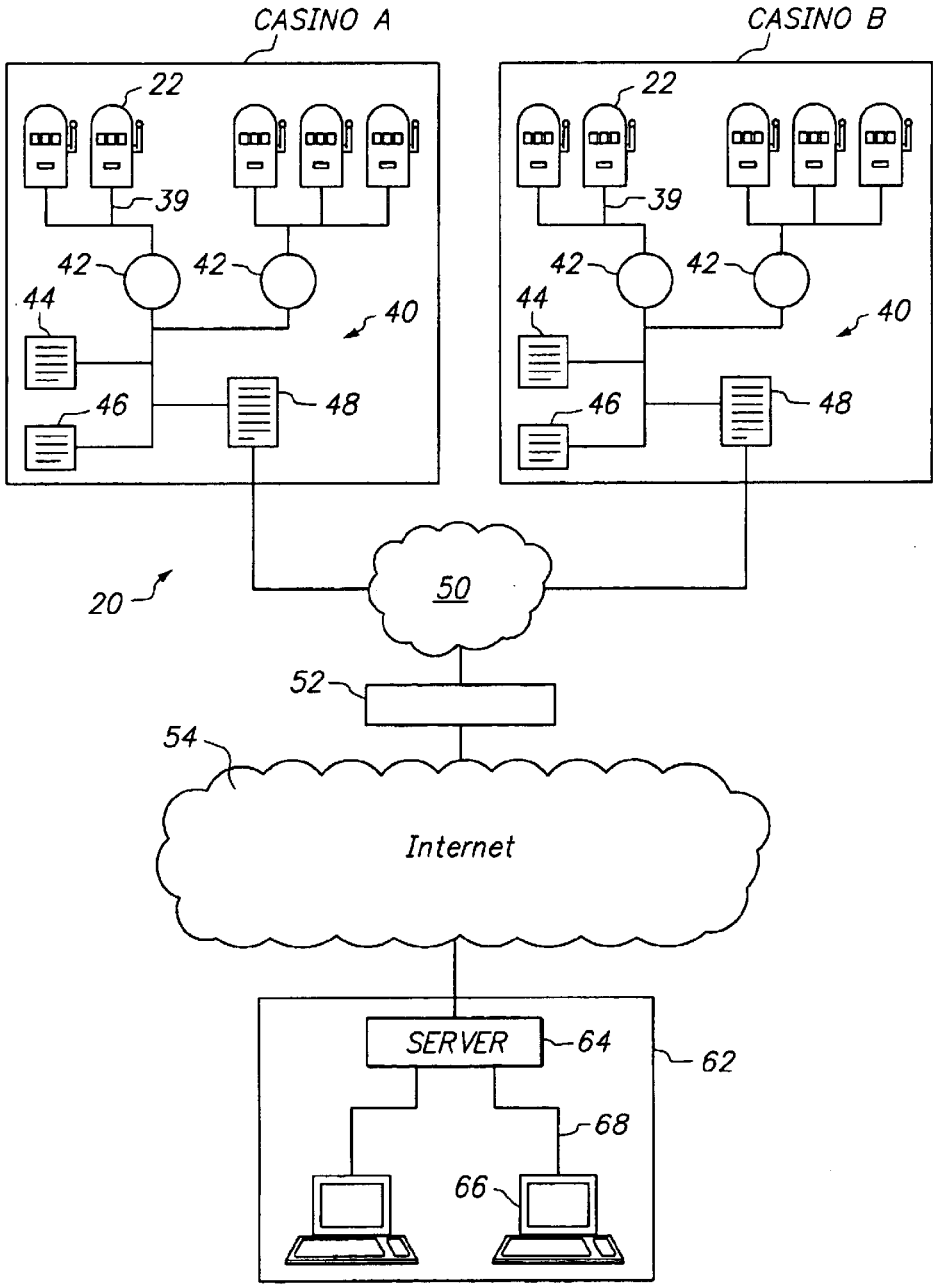
FIG. 2 illustrates one embodiment of a system of the present invention.

FIG. 2 illustrates one embodiment of a gaming system 20 of the invention, the gaming system 20 including a plurality of gaming machines 22. The gaming machines 22 may be located in a variety of places. In one embodiment, the gaming machines 22 may be located in various locations within a single casino. As described below, the gaming machines 22 may also be located in multiple casinos or locations.

In one embodiment, a communication link 39 is provided which permits the gaming machine 22 to communicate with external devices. To facilitate communication, the gaming machine 22 may include a communication interface (not shown). As is known, the configuration of the interface will generally depend upon the manner of communication, including any particular communication protocol utilized.

For example, if the link is a wireless link, the protocol/architecture may be Bluetooth or IEEE 802.11(b). For wired links, the protocol/architecture may be RS-232, IEEE-1394 (Firewire™), TCP/IP or Ethernet.

In one embodiment, the gaming machines 22 are associated with a common network 40. This network 40 may be of a variety of types, include a variety of devices, and be configured to accomplish a variety of functions. The network 40 may have a variety of configurations and comprise wired, wireless or a combination of wired and wireless communication pathways. Depending upon the configuration of the network 40, the network 40 may comprise a wide variety of components. For example, the network 40 may include wireless communication relays or transceivers. The network 40 may also include one or more hubs or routers. The network 40 may include dedicated or public lines. For example, one or more portions of the network 40 may include the Internet, phone lines or the like.

In one embodiment, the network 40 is or is part of an accounting network. For example, the network 40 may be arranged to implement International Game Technology's EZ-PAY™ system. In accordance with this system, as described above, the gaming machines 22 are arranged to print tickets or receipts representative of value in lieu of dispensing coins as awards for winning game play or game machine cash-out. In addition, the gaming machines 22 are arranged to accept receipts as value, such as for placing bets.

Such a network 40 may have a variety of configurations. One such network 40 is illustrated in FIG. 2. In one embodiment, banks or groups of gaming machines 22 are associated with a validation terminal 42. The validation terminal 42 is preferably arranged to route and concentrate data. The network 40 also includes one or more accounting stations 44. These stations 44 may comprise computing devices including data input and output devices, such as a keyboard, mouse and video display. A user of the station 44 may view and manipulate information or data. In one embodiment, the accounting station 44 is arranged to execute program code to accomplish a variety of accounting related functions, such as tracking amounts issued in the form of printed receipts by the gaming machines 22 and the like.

The network 40 may include a variety of other devices. For example, one or more printing devices 46 may be utilized to print reports, receipts and other documents. Though not shown, other devices, such as hand-held portable devices, other computing stations, relays, routers and the like may be utilized to implement the network 40.

In one embodiment, the various devices of the network 40, including the gaming machines 22, are in communication with at least one main computing device or server 48. In one embodiment, the server 48 is both part of the local area network (LAN) of the casino, and a larger wide area network or WAN 50. This WAN 50 may include LAN of several other casinos or properties. In the illustrated embodiment, gaming machines 22 are located at two different casinos in different geographic locations. Each has its own internal network 40, including a server 48 which provides a communication bridge to and from its particular LAN and other LAN and devices of the larger WAN 50.

In one embodiment, one or more computing devices such as servers 52 serve as a gateway between the WAN 50 and other networks, including the World Wide Web or Internet 54. The WAN 50 may include, or be associated with, a wide variety of other devices, systems and networks. For example, in one embodiment, a central server may be connected to the WAN 50 and be used to track all individual receipts or other accounting transactions executed within or associated with the particular LANs. This arrangement permits cross-validation, for example, of receipt. A receipt issued by a gaming machine 22 at one casino may be taken to another casino for redemption. Information regarding the issued receipt may be stored at the central server. When the receipt is presented at another gaming machine, information regarding the receipt may be transmitted to the central server for confirmation.

It will be appreciated that the gaming machines 22 may be associated with networks other than, or in addition to, the network 40 described above which is arranged to implement a receipt system. For example, the gaming machines 22 may be associated with a player tracking network. Such systems, which are well known, may be configured to match game play data with particular players. Player identity and game play information may be transmitted from the individual gaming machines 22 to a server. The server may track and aggregate a player's game play. Awards may be provided to players based upon a variety of criteria, including thresholds of game play. In one embodiment, the player tracking network may include one or more of the same components as the network 40 described above.

In a preferred embodiment, the system 20 of the invention includes a network operations center 62. In accordance with the invention, information, such as diagnostic and repair data, may be transmitted to the network operations center 62 from the gaming machines 22 or other devices of the networks 40, and from the network operations center 62 to those devices.

In one embodiment, the network operations center 62 includes one or more servers 64 or other devices configured to send and receive data. Preferably, the network operations center 62 includes one or more technician stations 66 including computing devices.

The operations center 62 may be configured in a variety of manners. In one embodiment, for example, a firewall may be provided to ensure that unauthorized information does not reach the computing stations 66. This firewall may comprise hardware and/or software, such as software executed by the server 64.

The network operations center 62 may include various sub-networks or LANs, and be connected to other devices and components, including other networks. For example, in one embodiment, the operations center 62 may itself be a LAN which is part of a larger WAN of the manufacturer of the gaming machines 22 or other devices or which otherwise is providing the support service.

In one embodiment, the regulatory bodies, such as state gaming boards, may be in communication with the operations center 62. As described in more detail below, in various embodiments of the invention, information is transmitted from the gaming machines 22 and other devices to the operations center 62, and from the operations center 62 back to the gaming machines 22 or other devices. Regulations may require that certain of this information be provided to the regulatory agency or that approval for certain actions be obtained before their performance. In one embodiment, the information may be transmitted via the communication link to the regulatory agency.

It will be understood that the operations center 62 need not be a "center" in the sense that it is geographically located at one location. To the contrary, the operations center 62 may be a plurality of devices which are connected by one or more communication links 68, such as via the common server 64.

The network operations center 62 may comprise a wide variety of devices and apparatus, preferably arranged to accomplish one or more of the methods described below. These devices may include, for example, one or more printing devices for printing work orders or tickets, computing devices for generating computer code, data mass storage devices for storing messages and other data received from the gaming machines 22 or other devices of the network 40, data mass storage devices for storing computer code, and computing equipment for executing computing code such as diagnostic code and message analyzation code.

In accordance with the invention, there are one or more methods of providing support to devices of a gaming network, such as by use of the system 20 illustrated in FIG. 2 and described above. One embodiment of a method will be described with reference to FIG. 3.

A first step S1 comprises monitoring a desired device or system. In one embodiment, for example, this step S1 comprises monitoring one or more activities at a gaming machine. A variety of activities at a gaming machine may be monitored. The activities may be associated with hardware and/or software. For example, the operation and/or status of a hard disk, memory, system bus, an operating system, processor or the like may be monitored.

In a step S2, it is determined if a particular event has occurred. In one embodiment, the event is an error or fault. Such errors may include hardware faults. Hardware faults may include, but are not limited to, disk I/O or R/W failures, memory errors, and system bus errors. The errors may include software faults. Software faults may include, but are not limited to, fault detected by the operating system of the gaming machine or by other software components. It will be appreciated that the particular errors or faults may depend upon the particular hardware and/or software utilized by the gaming machine.

In one or more embodiments, system errors or faults of the type just described may be logged, such as in an event log associated with an operating system. In one embodiment, the gaming machine may utilize an operating system such as Window NT®, and software and hardware faults may be reported to a log thereof. In accordance with the invention, the step S2 of determining if a fault has occurred may comprise scanning or monitoring the event log of the operating system for an indication of faults or errors.

In other embodiments, the events simply comprise activities or actions performed by one or more of the components of the gaming machine. The events may also comprise particular characteristics or parameters. For example, an event may comprise a level of detected CPU kernel usage, an event of memory or disk usage or the like.

In one or more embodiments, the events may be associated with a variety of components of the gaming machine. For example, as described above, in one embodiment a gaming machine may be arranged to accept and issue receipts in lieu of coins, currency or other forms of credit. The events may be related to the ticket or receipt printing and acceptance system. Particular events may be associated with reels, a video display, a player tracking card reader or keypad, gaming machine push-bottons, and other components of the machine.

In one embodiment, an event may comprise a detected parameter, group of parameters or trend of a parameter or group of parameters. For example, an event can comprise a data trend indicating that the machine is issuing receipts at a higher rate than normal, or has an average payout which is higher than expected.

In a step S3 of the invention, a message is generated regarding at least one detected event. The message may contain a variety of information. In one or more embodiments, the information includes gaming machine identification information. The information also preferably includes information regarding the particular event. For example, the information may detail a particular fault or error which occurred, or other activity, such as detected memory or disk usage.

In one or more embodiments, in a step S4 the message is encoded. In one embodiment, the message may be encrypted. The type and manner of encoding or encryption may vary in accordance with methods now known or later developed. For example, the message may be encrypted using symmetrical or asymmetrical key encryption methods.

In a step S5, the message is transmitted from the generating device, such as the gaming machine, to a remote location. Preferably, the remote location is a service center, such as the operations center 62 of the system illustrated in FIG. 2 and described above. In a step S6, the message is received at a remote location, such as at a particular device at the remote location.

Figure 3:
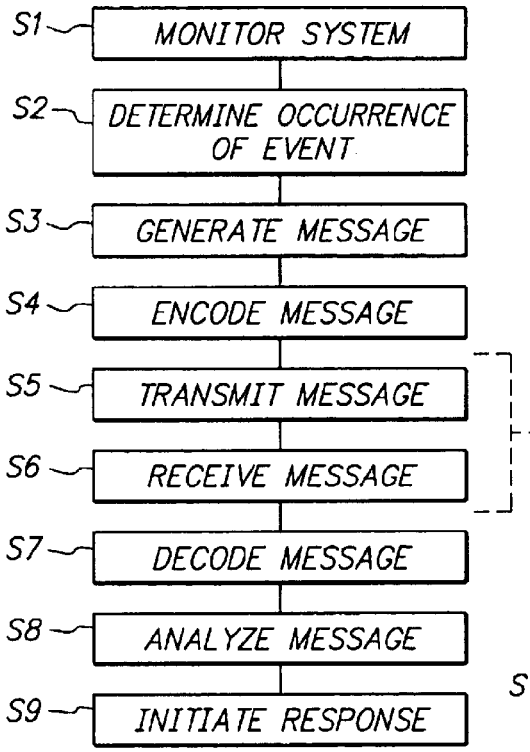
FIG. 3 is a flow chart illustrating an embodiment of a method of the invention.
Figure 3A:
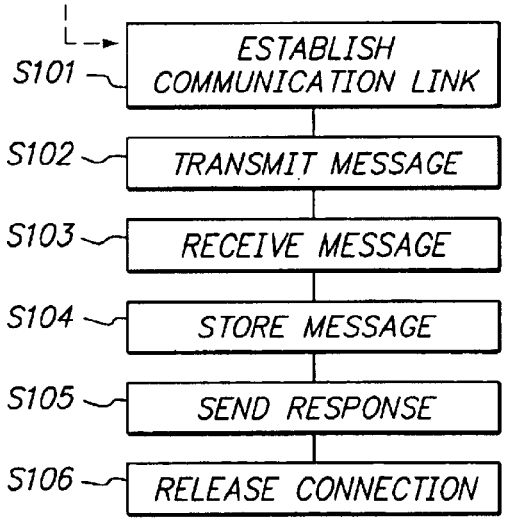
FIG. 3A is a flow chart illustrating in greater detail one method of performing one of the steps of the method illustrated in FIG. 3.

One particular embodiment of a method comprising steps S5 and S6 of sending or transmitting a message and receiving a message is illustrated in FIG. 3(*a*). In a preferred embodiment of the invention, a generated message is transmitted in accordance with the simple mail transfer protocol (SMTP). In accordance with this embodiment of the invention, the message may first be encapsulated. In this step (not shown), for example, the message may be provided with an address header and other information.

In a second step S101, a communication link is established between the sending source and the recipient. Preferably, this link is a transmission control protocol (TCP) connection. In the embodiment system illustrated in FIG. 2, this step S101 may comprise establishing a communication link from a particular gaming machine 22 over the network 40 to the operations center 62. In one embodiment, this may comprise establishing a communication link via the WAN 50 with the server 52 via the Internet 54 with the server 64 at the operations center 62. In this embodiment, the sending source is thus the gaming machine 22, and the recipient is the server 64 at the operations center 62. As is known in the art, the step of establishing the communication link using SMTP includes the recipient, such as the server 64, indicating that it is ready to accept the message. If the recipient is not ready to accept the message, the sending source generally is configured to release the communication connection and try again later.

In a next step S102, the message is transmitted. This step S102 comprises the data being transferred from the sending source, such as the gaming machine 22, to the recipient, such as the server 64. In a step S103, the message is received. When the message is received by the recipient, the message may be stored, as in a step S104. In one embodiment, the message is stored in a memory. The message may also be routed to long term storage, such as a hard disk.

In a step S105, when the message is received, a response is generated and transmitted back. For example, in the system illustrated in FIG. 2, the server 64 generates a response and sends it back to the gaming machine 22 indicating that the message was received.

In a step S106, the communication link or connection is released or disconnected.

In one embodiment, other methods may be utilized for transmitting the message. For example, the message may be routed over a network (such as network 40) or the Internet using other protocols other than SMTP. As is known, in some methods of communication, however, the data (i.e. message) may be stored at one or more times and at one or more locations and not be immediately delivered to the recipient. This, of course, may lead to a delay in receipt of the message by the recipient, such as the operations center 62. Thus, in a preferred embodiment, the method of message transmission is by means causing the message to be immediately transmitted through to its destination.

In one embodiment of the present invention, as in the system 20 described above, the message is routed via the Internet. Preferably, the protocol/means used to transmit the message is one causing direct transmission to the recipient. As indicated, SMTP is one such protocol. Other means may be utilized. For example, extended SMTP (ESMTP) may be used. Yahoo! Messenger™, MSN Messenger™ and ICQ™ are other tools which are known and may be utilized to transmit the messages.

Preferably, the means by which the messages are transmitted over the network or other communication links is similar, providing for minimized storage and direct transmission to the recipient. In one embodiment, the gaming machine or other device may be connected to the recipient, such as the operations center 62, by a dedicated or direct communication link. In such an arrangement, the means of data transmission is immediate and direct, avoiding the above-stated problems.

Referring again to FIG. 3, once the message is received at the remote location, such as the server 64 at the operations center 62 in the system illustrated in FIG. 2, the message is preferably decoded or decrypted in a Step S7. It will be appreciated that the particular method of decoding or decrypting may depend upon the method of encoding or encrypting.

Preferably, in a step S8 the message is analyzed. In one embodiment, this step S8 may comprise classifying the content of the message. For example, messages may be classified into categories such as "hardware error/fault," "software error/fault" or "system data/metric information." The message may be classified in a variety of other manners as well. For example, the message may be classified by the type of device, device manufacturer or the like. Of course, the message preferably includes information regarding the specific parameters which are utilized to classify the message, such as the name of the manufacturer of the device generating and transmitting the message.

In one embodiment, the analyzing step S8 may be performed in an automated fashion, or done manually. For example, in one embodiment, when a message is generated that message may be provided with a code corresponding to the particular category to which the event corresponds. The step of analyzing may comprise the step of determining the code provided with the message. In another embodiment, the method may comprise the screening of the message, such as by a reader.

A step S9 comprises initiating or implementing a response to the message. The particular response may depend upon the message. For example, the response may comprise simply storing or logging the message. This response may be appropriate when the message is simply providing information regarding a particular system metric. For example, data may be stored regarding CPU or memory usage at a gaming machine, which data may be used for a variety of purposes in the future.

In another embodiment, the response may comprise generating a response message electronically, or generating a service order or the like which is filled out by a technician who calls personnel at the location of the gaming machine or who travels to the gaming machine. The particular response may depend, in part, upon the particular message received.

In one embodiment, the response may be by generating or obtaining software code or other information and then the transmission of that code or information back to the gaming machine or other device for use. For example, if the gaming machine identifies that a software code error has occurred, a software patch may be obtained or generated and then transmitted back to the gaming machine for installation and use.

If event code or other information is provided to the gaming machine, appropriate measures may be taken to ensure the authenticity of the code and ensure its safe transmission to the gaming machine. These measures may include, but are not limited to encryption, encoding, and cross-verification of the transmitted information or code.

In another embodiment, the response may be a work ticket. The work ticket may be a written instruction for a technician to travel to the gaming machine or other device to render service, such as repairs. The work ticket preferably includes a description of the problem and an identification of the gaming machine or other device in need of service. The work ticket may include information regarding the location of the gaming machine or other device in need of service. In one embodiment, the work ticket may include specific instructions to the technician regarding how to effect the service or repair.

In one embodiment, the method may include the step of assigning a unique identification number, such as a "tracking number" or "ticket" to the message. In this manner, each message may be uniquely identified. In one embodiment, the method may include the steps of assigning identification numbers to received messages, generating one or more files with which the messages are stored, and then updating the file with information regarding actions taken. For example, responses may be logged to the file and assigned the same identification number. In this manner, the status of messages, including any response, may be obtained. The status may be obtained, for example, by utilizing the identification number to locate the file for the matter and then examining the various messages or other information.

Various other embodiments of methods are contemplated. In one or more embodiments, the methods of the invention may be implemented with systems or apparatus different than that illustrated in FIG. 2 and described above.

In one embodiment, a second or independent communication link may be established for transmitting a response to a message. In this embodiment, a first communication link may be used to transmit the error message, request for service or the like. If a response is generated which requires transmission to a remote device, such as from the operations center 62 back to the gaming machine 22, in one embodiment a second communication link is established. This communication link may be through a separate network or system.

In another embodiment, the first communication link is terminated and then a second established, though the links may have the same route and pass through the same devices. In another embodiment, a single communication link may be utilized to transmit the message and any response. For example, in one embodiment, the code or other data is transmitted to the gaming machine or other device in an immediate fashion using the same communication link as was used to transmit the message from the gaming machine or other device to the operations center. If the message were transmitted using Yahoo! Instant Messenger™, the same may be utilized to transmit the code or data.

The methods of the invention may be applied in a variety of manners. As indicated above, the method of the invention may be applied to a gaming machine or related devices. As indicated above, in one embodiment, one or more of the gaming machines may be arranged to accept receipts or tickets and issue receipts or tickets. In one embodiment, the gaming machines include appropriate software and hardware for accomplishing these functions. In one embodiment, the gaming machines are further associated with a server which generates ticket, accounting and other information, and receives like information from the gaming machines. In this manner, appropriate accounting for the tickets or receipts is carried out, and tickets or receipts may be used interchangeably at different gaming machines. Such a system is currently in operation as implemented by International Game Technology and is known as the EZ-PAY™ system. This system is described in greater detail in U.S. application Ser. No. 09/544,884 filed on Apr. 7, 2000, incorporated herein by reference in its entirety.

In one embodiment, the method of the invention may be applied to the devices of the EZ-PAY™ or a similar system and the devices thereof. In one embodiment, in the EZ-PAY™ system the server is configured as a computing device including a processor or processing unit, memory, controllers and the like, and utilizes an operating system such as Windows NT®. The server runs various application software, such as SQL Server and ArcServeIT.

As is known, operating systems such as Windows NT® generate an event log. As described above, this event log may be monitored to determine the occurrence of particular events.

The systems and methods of the invention have numerous advantages. First, the system and method provide for a centralized system for monitoring gaming machine and related device activities, including faults and errors. Thus, though gaming machines may be spread across various properties which are geographically remote, the operation of those machines may be monitored by a central mechanism (though, as indicated, this mechanism may comprise an operations center which does not necessarily comprise components in one geographic location).

The system and method also provide an improved means for servicing gaming machines and related equipment. In accordance with the invention, event data, such as information regarding errors or faults, is immediately transmitted to a remote location for analyzation. No longer do casino personnel need to discern that a particular gaming machine is malfunctioning and report the malfunction. Further, casino personnel do not need to attempt to identify the probable cause of the malfunction. Instead, detailed information regarding the fault, error or other event is provided directly by the gaming machine.

In accordance with the system and method of the invention, information regarding events is routed to the appropriate recipient, and can be stored and processed, all in a manner avoiding direct human intervention. In the prior art, a malfunction would not be reported unless a person identified the malfunction, and then placed a telephone call or the like and was able to speak to an appropriate party. In accordance with the method, messages are automatically transmitted and received. These messages can be automatically logged and stored for future use, and can be analyzed and acted upon in an undelayed manner without direct human contact.

In a preferred embodiment of the invention, messages are transmitted by SMTP or other instant means of transmission/receipt over the Internet or other communication links. This ensures that a message is not delayed or is not delivered, avoiding this common problem with other transmission methods and systems.

In accordance with the invention, certain repairs and the like may be effected without the need for a technician to travel to the gaming machine or other device. Instead, gaming code or other information may be generated and transmitted to the gaming machine, such as by using the same communication link as the gaming machine utilized to send its message.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of providing support to a gaming device comprising:

determining the occurrence of an event meeting a predefined criteria at said gaming device;

generating a message regarding said event;

transmitting said message from said gaming device to a remote service center utilizing a dedicated communication link between said gaming device and remote service center;

analyzing said message regarding said event;

generating program code for use by said gaming device in response to said message regarding said event; and transmitting said program code to said gaming device.

2. A method for supporting a gaming machine from a remote location comprising the steps of:

monitoring said gaming machine;

determining an occurence of an event at said gaming machine;

generating a message regarding said event;

encoding said message;

transmitting said message to said remote location, said message transmitted over a communication link including at least a portion of the Internet utilizing SMTP;

receiving said message at said remote location;

decoding said message;

analyzing said message; and initiating a response to said message, wherein said initiating step comprises generating program code for use by said gaming machine and transmitting said program code to said gaming machine from said remote location.

3. The method of claim 2, wherein said event comprises an error or fault at said gaming machine.

4. The method of claim 2, wherein said event comprises a change in a parameter or characteristic of said gaming machine.

5. The method of claim 2, wherein said analyzing step comprises classifying said message based upon said event.

6. The method of claim 2, wherein said gaming machine is associated with a network, said network including a server connected at one or more times to the Internet, and said remote location comprises a service center including a host connected at one or more times to the Internet.

7. The method of claim 2, further including the step of:

establishing a point-to-point dedicated communication link between said remote location and said gaming machine, wherein said transmitting step involves transmitting said message over said dedicated communication link.

8. The method of claim 2, wherein said message is transmitted from said gaming machine to said remote location over a first communication link and said step of initiating a response comprises transmitting a response from said remote location to said gaming machine over a second communication link.

9. The method of claim 2, further including the step of:

storing said message at said remote location.

10. The method of claim 2, further including the step of:

assigning a unique identifier to said message.

11. The method of claim 10, wherein said unique identifier includes information identifying said gaming machine for which said message was sent.

12. A method of supporting a gaming machine adapted for accepting a wager from a player, playing a game, and granting a monetary award to the player based on an outcome of the game, the method comprising the steps of:

monitoring said gaming machine for the occurrence of any event requiring repair, intervention or correctional action associated with said gaming machine;

detecting an occurrence of an event at said gaming machine that results in a need or desire for repair, intervention or correctional action with respect to said gaming machine;

generating a message regarding said event, said message including information regarding at least the identity of said gaming machine and the nature of said event;

transmitting said message to a location remote from said gaming machine over a communication link including at least a portion of the Internet and utilizing a simple mail transfer protocol;

analyzing said message at said remote location to determine the type of event that has occurred and the type of response to be taken; and initiating a response to said message at said remote location, wherein said response contains one or more details regarding a recommended or necessary repair, intervention or correctional action to be taken with respect to said gaming machine as a result of said event.

13. The method of claim 12, wherein said step of initiating a response comprises generating a service order for personnel at the location of the gaming machine.

14. The method of claim 12, further including the step of:

conducting a repair or corrective measure on said gaming machine in accordance with said response to said message.

15. A method of providing support to a gaming machine comprising:

determining the occurrence of an event meeting a predefined criteria at said gaming machine, said gaming machine being adapted for accepting a wager from a player, playing a game, and granting a monetary award to the player based on an outcome of the game;

creating a message regarding said event, said message including information regarding at least the identity of said gaming machine and the nature of said event;

transmitting said message from said gaming machine to a remote service center utilizing a dedicated communication link between said gaming machine and said remote service center;

analyzing said message at said remote service center to determine the type of event that has occurred and the type of response to be taken; and generating a response to said message at said remote service center, wherein said response contains one or more details regarding a recommended or necessary repair or correctional action to be taken with respect to said gaming machine as a result of said event.

16. A gaming system adapted for providing automated support to one or more gaming machines contained therein, comprising:

a plurality of gaming machines adapted for accepting wagers from players, playing games thereupon and granting monetary awards to players based on the outcomes of said games, wherein each of said plurality of gaming machines includes a dedicated master gaming controller adapted to provide one or more gaming events and control a plurality of gaming machine functions, an external cabinet defining an interior region and adapted to house a plurality of gaming machine components therein, and at least one display device located within or about said external cabinet and adapted to display gaming related information thereupon;

one or more programs adapted to detect the occurrence of an event meeting predefined criteria occurring at one or more affected gaming machines of said plurality of gaming machines, to generate an event message in response to a detected event, and to transmit said event message to a remote location, wherein said event message contains information regarding at least the identity of the affected gaming machine or machines and the nature of said event;

a remote server located at said remote location and adapted to analyze said event message to determine the type of event that has occurred and the type of response to be taken, and to generate a response to said event message, wherein said response contains one or more details regarding a recommended or necessary repair or correctional action to be taken with respect to said affected gaming machine or machines as a result of said event; and at least one communication link or path between said affected gaming machine or machines and said remote server.

17. The gaming system of claim 16, wherein at least two of said plurality of gaming machines are linked by a common local area network, wherein said local area network is part of a larger wide area network including multiple local area networks, and wherein said at least one communication link or path is established through said local area network and said wide area network from said affected gaming machine or machines to said remote server.

* * * * *